US006615422B2

(12) United States Patent
Hecker

(10) Patent No.: US 6,615,422 B2
(45) Date of Patent: Sep. 9, 2003

(54) BATH TAP FITTING

(75) Inventor: Hans-Hermann Hecker, Oberboihingen (DE)

(73) Assignee: Hansa Metallwerke AG (DE)

( * ) Notice: Subject to any disclaimer, the term of this patent is extended or adjusted under 35 U.S.C. 154(b) by 0 days.

(21) Appl. No.: 10/100,777

(22) Filed: Mar. 19, 2002

(65) Prior Publication Data

US 2002/0133875 A1 Sep. 26, 2002

(30) Foreign Application Priority Data

Mar. 26, 2001 (DE) ..... 101 14 855

(51) Int. Cl.[7] ..... E03C 1/04

(52) U.S. Cl. ..... 4/675; 4/678; 285/90; 285/330; 137/801

(58) Field of Search ..... 4/675, 678, 496; 137/801, 359; 285/404, 90, 330, 331, 322, 323

(56) References Cited

U.S. PATENT DOCUMENTS 3,951,436 A * 4/1976 Hyde, Jr. ..... 285/27
4,401,324 A * 8/1983 Rumble ..... 285/90
5,363,931 A * 11/1994 Moriarty ..... 175/325.5
6,195,818 B1 * 3/2001 Rodstein et al. ..... 4/678

FOREIGN PATENT DOCUMENTS

DE 41 08 458 9/1992

* cited by examiner

*Primary Examiner*—David J. Walczak
*Assistant Examiner*—Azy Kokabi
(74) *Attorney, Agent, or Firm*—Factor & Partners

(57) ABSTRACT

A bath tap fitting in the known way comprises a securing device which can be attached to a mounting plate. This has a securing body which extends upward and in its upper area possesses a multi-faced outer contour. An outlet spout can be fitted to the securing body with a multi-faced seating aperture so that it does not turn. A locking screw can be screwed through a threaded hole of the outlet spout against the securing body so that two faces of the seating aperture of the outlet spout, enclosing an angle with each other are pressed against two faces of the securing body enclosing a corresponding angle. In this way the securing body is "wedged" in the seating aperture of the outlet spout. The outlet spout sits absolutely firmly on the securing body.

3 Claims, 3 Drawing Sheets

BATH TAP FITTING

The invention relates to a bath tap fitting with a) a securing device, which can be attached to a mounting plate and comprises a securing body extending upwards, which at least in its upper area possesses a multi-faced outer contour;

b) an outlet spout, which can be seated on the securing body with a multi-faced seating aperture so that it does not turn;

c) a locking screw screwed through a threaded hole of the outlet spout, the face of which can be pressed against the outer contour of the securing body and as a result one face of the seating aperture of the outlet spout presses against a face of the securing body.

Good quality bath tap fittings can have considerable dimensions. If the user for example when climbing into a bathtub holds onto the bath tap for support considerable forces and torques can act on this. The demands on the stability of the connection between outlet spout and securing device, which in turn is fitted to the mounting plate, are therefore quite enormous. In order to be able to fit the seating aperture of the outlet spout onto the securing body so that it does not turn, certain, although minor play is essential. This play would be eliminated as far as possible with aid of the locking screw, which at the same time secures the outlet spout to the securing body.

With known bath tap fittings of the type detailed at the beginning, the configuration was such that the uppermost area of the securing body possessed a four-faced multi-edge profile, this securing body thus essentially having a square cross-section. The seating aperture of the outlet spouts was essentially shaped complementarily. The threaded hole of the outlet spout, into which the locking screw was screwed, was angled so that it opened out into a flat face of the seating aperture. The consequence of this was that the locking screw also pressed against a flat face of the securing body, as a result of which the opposite-lying parallel flat faces of the securing body and the seating aperture of the outlet spouts were pressed against each other. As a result although the play which existed between the outlet spout and securing body in the direction of the movement of the locking screw was eliminated, play between the outlet spout and the securing body in the direction parallel to the faces pressed against each other was still possible here nevertheless. The user who held onto the bath tap fitting for support could therefore feel a certain degree of instability, albeit slight. Although this was in fact not dangerous, since the play was only minute, it was psychologically disconcerting for the user and gave an impression of inferior quality.

The aim of the present invention is to design a bath tap fitting of the type detailed at the beginning so that the connection between the outlet spout and the securing body is absolutely firm, even when large forces are applied.

This aim according to the invention is achieved in that d) the threaded hole of the outlet spout and the locking screw which can be screwed into this is angled in comparison to the profile of the seating aperture of the outlet spout and the outer contour of the securing body so that when the locking screw is screwed in, two faces of the seating aperture of the outlet spout standing at an angle to each other are pressed against two faces of the securing body standing at a corresponding angle to each other.

According to the invention therefore, in comparison to the state of the art, there is no longer only one face of the seating aperture of the outlet spout which is pressed against a face of the securing body, which allowed certain play parallel to these faces. Instead the locking screw presses an "angle" of the seating aperture of the outlet spout, which is enclosed by two faces, against an "edge" of the securing body which is also enclosed by two faces. Now in the interaction with the locking screw itself any play parallel to two faces lying next to each other of the seating aperture on the one hand and securing body on the other is no longer possible. The outlet spout sits absolutely firmly on the securing body of the securing device.

It is advantageous if the cross-section of the securing body has the shape of a polygon with rounded corners and if the locking screw strikes a rounded connecting face between two adjacent flat faces of the securing body. The rounded connecting face ("edge") struck by the locking screw in this case lies diagonally opposite that rounded connecting face ("edge") which is enclosed by the two faces producing the "wedging".

It is especially simple if the cross-section of the securing body has the shape of a square with rounded corners.

BRIEF DESCRIPTION OF THE DRAWINGS

An embodiment of the invention is explained in more detail below by way of the drawings; these show FIG. 1 an axial sectional view through a bath tap fitted to a mounting plate.

DETAILED DESCRIPTION OF THE DRAWINGS

Figure 1:
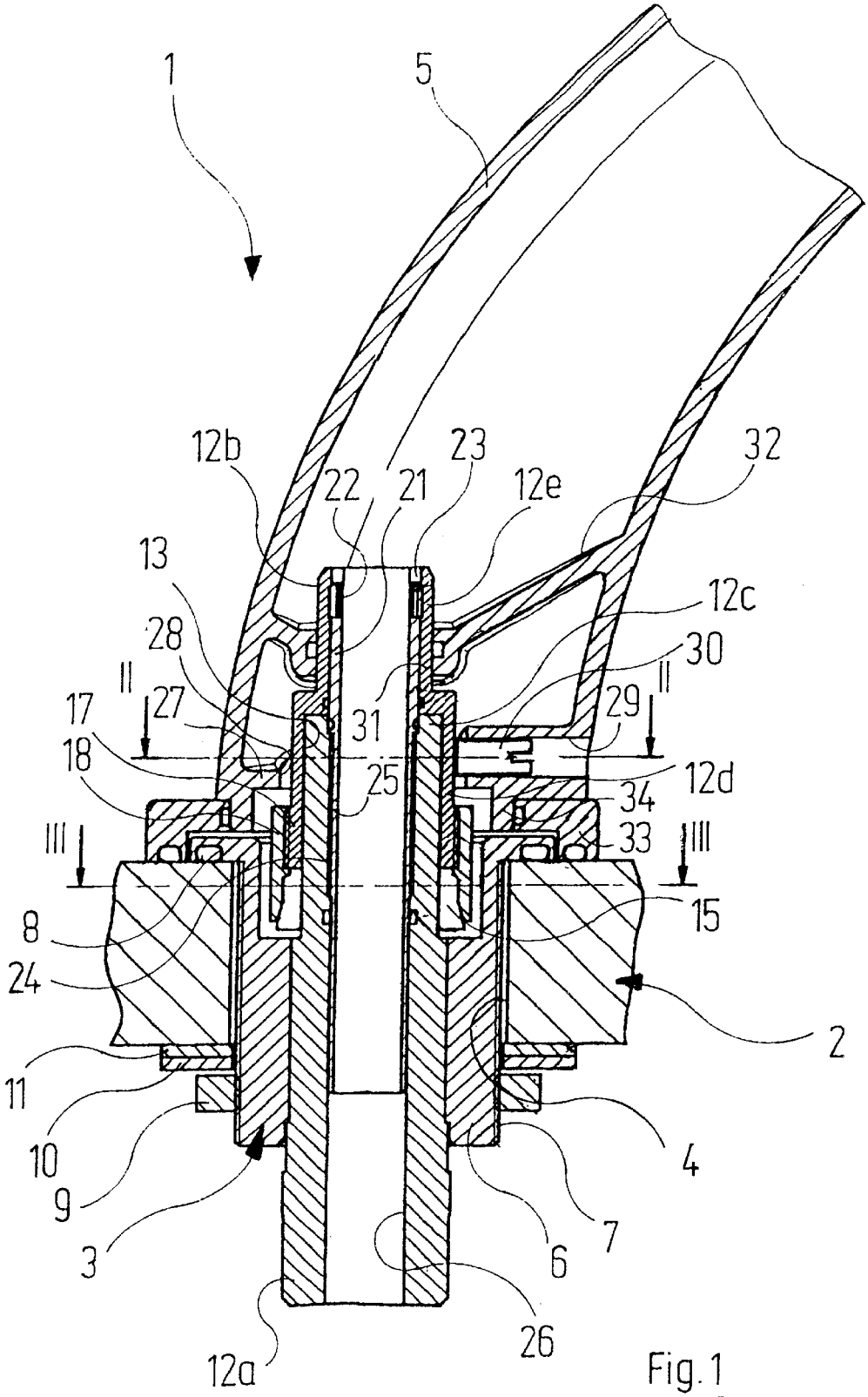

FIG. 1 shows a bath tap, the whole of which is identified with the reference number 1 and is fitted to a mounting plate 2, for example a carrier frame for bathtub edge mounting. The bath tap 1 includes a securing device 3, which is mounted in a drilled hole 4 of the mounting plate 2 in the way described below as well as an outlet spout 5 only partly shown, which is seated movably on the securing device 3 in a way also described further below.

The securing device 3 has a push-in nozzle 6 which is fed in through the drilled hole 4 of the mounting plate 2 from above and on its outer surface area supports an outer thread 7. A radially proud flange 71 which lies on the upper side of the mounting plate 2, with an O-ring—not shown inserted in between, is molded onto the upper end of the push-in nozzle 6. A nut 9 screwed from below onto the outer thread 7 of the push-in nozzle 6 when tightened with shim disks 10, 11 inserted in between, lies against the underside of the mounting plate 2, as a result of which the push-in nozzle 6 is secure.

A securing body 12 made up of an underpart 12*a* and an upper part 12*b* seated on this extends through the push-in nozzle 6. The underpart 12*a* of the securing body 12 is joined to the push-in nozzle 6 by soldering. In that axial area, in which the underpart 12*a* of the push-in part 12 lies on the push-in nozzle 6, it has a circular cross-section. A neck 12*c* which has a hexagonal cross-section is molded over it on the lower part 12*a*, as can be seen in particular from FIGS. 2 and 3.

The upper part 12*b* of the securing body 12 has a skirt 12*d* extending downwards and a neck 12*e* running upwards. The skirt 12*d* possesses an inside recess 13, the cross-section shape of which corresponds to the cross-section shape of the neck 12*c* of the underpart 12*a*, so that the neck 12*c* of the underpart 12*a* is seated in the recess 13 so that it does not turn.

Figure 2:
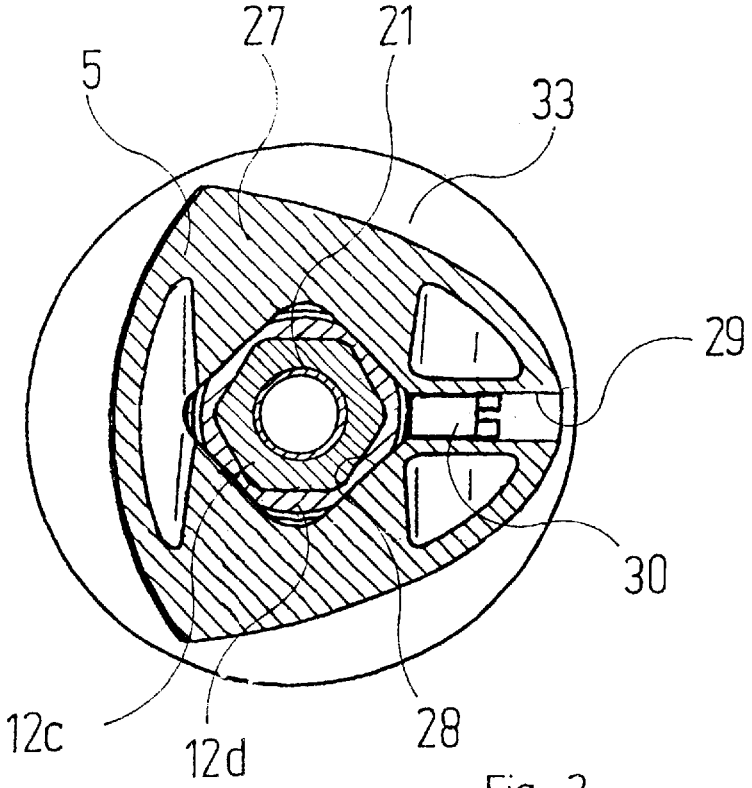
FIG. 2 a sectional view according to line II—II of FIG. 1.
Figure 3:
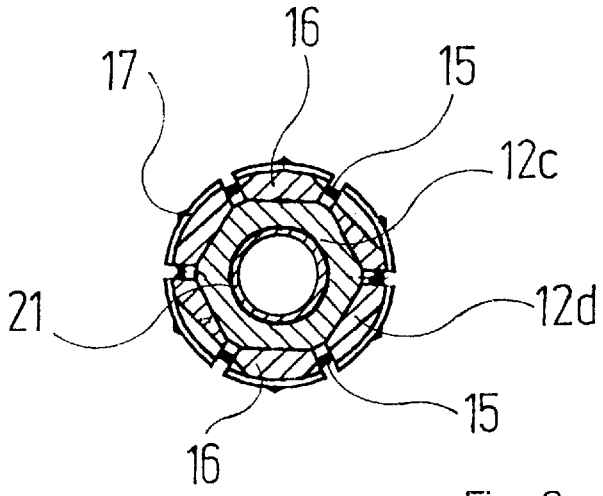
FIG. 3 a sectional view according to line III—III of FIG. 1 through the upper and lower part of a securing body used with the bath tap.
Figure 4:
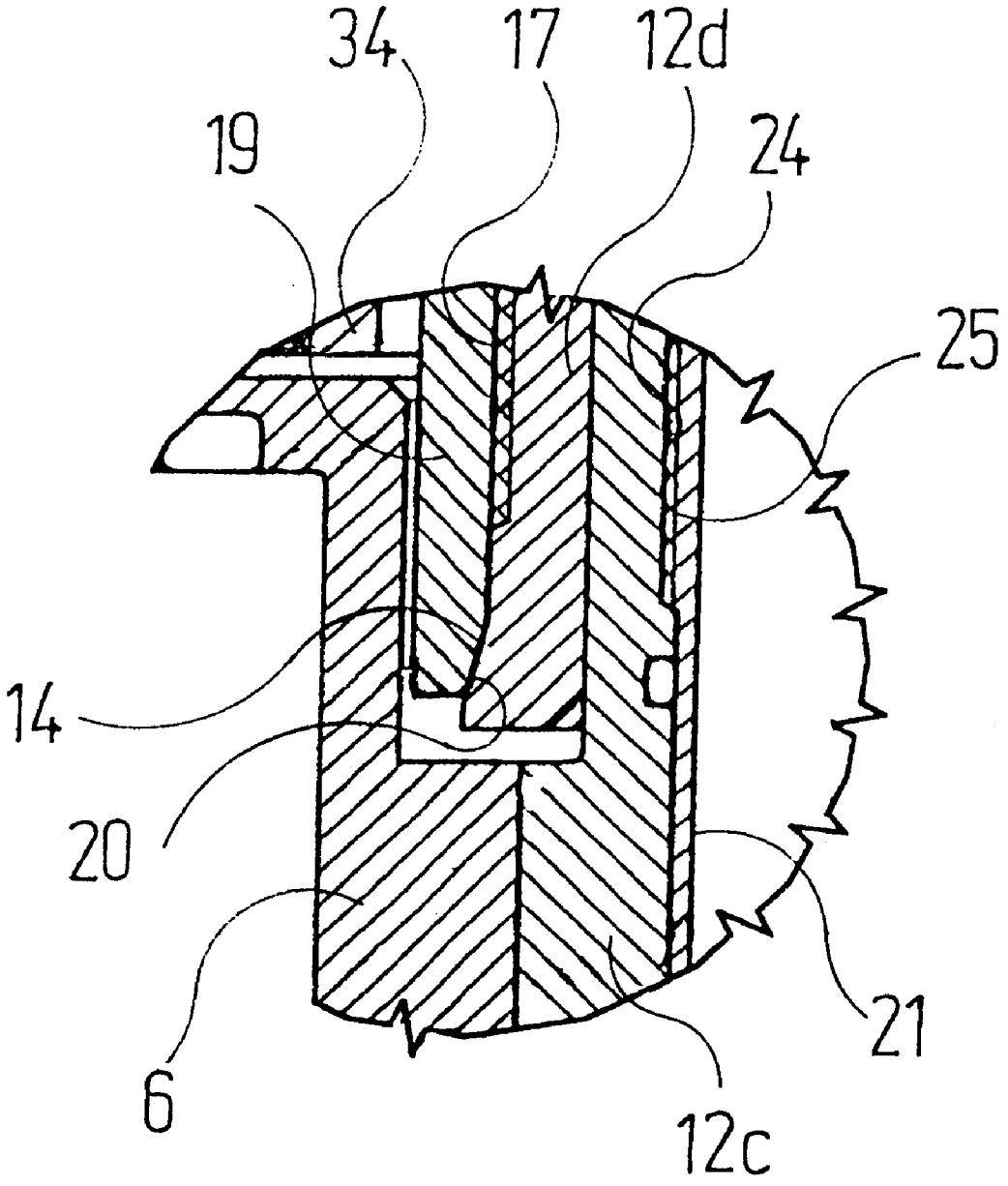
FIG. 4 a blown-up sectional view from FIG. 1.

The outer contour of the upper area of the skirt 12*d* of the upper part 12*b* of the securing body 12 has the cross-section shape of a square with rounded corners, as can also be seen from FIGS. 2 and 3. At the lower end the outer diameter of the skirt 12*d* is expanded over a cone face 14 (cf. FIG. 4) to a greater radius. In this lowest area the skirt 12*d* is also divided into individual segments 16 by slits 15 running parallel to the axis (cf. FIGS. 1 and 3).

In the area directly above the slits 15 an outer thread 17 onto which a nut 18 is screwed is cut into the outer surface area of the skirt 12*d* of the upper part 12*b* where the outer cross-section is circular. As also can be seen in particular from FIG. 4, a cone face 20 is also molded onto the inner surface area of a downward running skirt 19 of the nut 18, so that the radius of the inner surface area is expanded downward. The cone face 20 lies on the nut 18 on the roughly complementarily inclined cone face 14 of the skirt 12*d* of the securing-upper part 12*b*. The arrangement is obviously such, that by screwing down the nut 18 onto the outer thread 17 of the securing-upper part 12*b* the segments 16 located at its lower end can be pressed radially inwards against the neck 12*c* of the securing-underpart 12*a*.

An adjusting bush 21 is led from above into the drilled hole of the neck 12*e* of the securing-upper part 12*b* and axially fixed to this by a clip ring 22, whereby however relative turning between the adjusting bush 21 and the securing-upper part 12*b* is possible. For this purpose the clip ring 22 is engaged in grooves on the faces of the adjustment bush 21 and securing-upper part 12*b* turned toward each other. Two short, axially running slits 23 in which a workpiece can be fitted to turn the adjusting bush 21 are provided at the upper end of the adjusting bush 21.

The adjusting bush 21 extends with an area bearing an outer thread 24 into the drilled hole of the securing-underpart 12*a* and interacts with an inner thread 25 cut there. The adjoining area of the adjusting bush 21 further down has a smooth, cylindrical surface area which lies on the surface of the drilled hole 26 of the securing-underpart 12*a*.

The outlet spout 5 in the vicinity of its lower end has a first transverse wall 27 which is penetrated by a drilled hole 28 which also has the cross-section shape of a square with rounded corners. The skirt 12*d* of the securing-upper part 12*b* is led through the drilled hole 28 of the transverse wall 27; the flat faces of the skirt 12*d* in this case lie on the flat faces of the drilled hole 28 with hardly any play.

A grub screw 30 is screwed into a threaded hole 29 fed essentially radially through the transverse wall 27. The outer profile of the skirt 12*d* of the securing-upper part 12*b* is angled in comparison to the threaded hole 29 so that the grub screw 30 does not strike a flat face but the rounded connecting face between two flat faces of the skirt 12*d*.

The neck 12*e* of the upper securing part 12*b* penetrates a complementarily shaped drilled hole 31 in a second transverse wall 32 of the outlet spout 5 and is guided by this.

The underside of the outlet spout 5 lies on the upper side of a cover plate 33 which in turn lies on the upper side of the mounting plate 2 and partly covers the flange 8 of the push-in nozzle 6. A cylindrical guiding collar 34 molded on the underside of the outlet spout 5 in this case extends into the inside recess of the cover plate 33 and is guided in this way.

The bath tap 1 on the mounting plate 2 is fitted and adjusted as follows:

Firstly the unit consisting of push-in nozzle 6 and securing lower part 12*a* is fitted to the mounting plate 2. This is done by feeding the push-in nozzle 6 from above through the aperture 4 of the mounting plate 2, after which the nut 9 is screwed tight from below against the shim disks 10, 11 and thus indirectly against the underside of the mounting plate 2.

Now the securing-upper part 12*b* which together with the adjusting bush 21 forms a unit, is seated onto the securing-underpart 12*a*. For this purpose the lower area of the adjusting bush 21 is led into the drilled hole 26 of the securing-underpart 12*a*. This can be done firstly by pushing; as soon as the outer thread 24 of the adjustment bush 21 however engages the inner thread 25 of the securing-underpart 12*a*, the adjusting bush 21 and securing-upper part 12*b* are further moved by screwing the adjusting bush 21. The skirt 12*d* of the securing-upper part 12*b* is now pushed so that it does not turn over the neck 12*c* of the securing-underpart 12*a*. The downward movement is carried on so far as this is necessary in view of the thickness of the mounting plate 2 and any possible decorative covering on this, for example tiling. When the correct relative height of the securing-upper part 12*d* in comparison to the securing-underpart 12*a* is reached, the nut 18 is screwed onto the outer thread 17 of the securing-upper part 12*b*. The cone face 20 at the lower end of its skirt 19 now presses through a cam effect with the cone face 14 of the skirt 12*d* of the securing-upper part 12*b* the individual segments 16 of the securing-upper part 12*b* inwards against the corresponding faces of the securing-underpart. As a result any play between securing-upper part 12*b* and securing-underpart 12*a* is completely eliminated and moreover the relative vertical position between these two securing parts 12*a*, 12*b* is fixed.

Now the cover plate 33 is placed in position.

In a final stage the outlet spout 5 is fitted to the securing device 3. For this purpose the neck 12*e* of the securing-upper part 12*b* is led into the complementary drilled hole 31 of the second transverse wall 32 and the skirt 12*d* of the securing upper part 12*b* into the corresponding seating aperture 28 of the first transverse wall 27.

The outlet spout 5 is finally fixed on the securing-upper part 12*b* by screwing in the grub screw 30 inside the threaded hole 29 of the outlet spout 5. Its face is now pressed against a rounded connecting face of the skirt 12*d*, as a result of which the outlet spout is pulled in the opposite direction, in FIG. 1 i.e. to the right, so that the two flat faces of the seating aperture 28 lying on the left in FIG. 1 are pressed against the two adjacent flat faces of the skirt 12*d*. The skirt 12*d* is thus pressed by the grub screw 30 to a certain extent "into the corner" of the seating aperture 28, as a result of which a kind of jamming and tolerance-free fixing results in two directions which is reinforced by fixing in a third direction with the grub screw 30. In this way the outlet spout 5 is connected to the securing-upper part 12*b* completely devoid of play.

Even if great forces and torques are applied to the outlet spout the securing device 3 of the outlet spout 5 described remains firm.

The various structural elements of the securing device 3 which were described above, are sealed against each other at the necessary places by O-rings which have not been described in detail. The grooves in the structural elements, in which these seals are seated, are outlined in the drawing.

What is claimed is:

1. A bath tap fitting comprising:

a) a securing device which can be attached to a mounting plate and includes an upward extending securing body, which at least in its upper area possesses a multi-faced outer contour;

b) an outlet spout, which can be fitted to the securing body with a multi-faced seating aperture so that it does not turn;

c) a locking screw screwed through a threaded hole of the outlet spout, the face of which can be tightened against the outer contour of the securing body and as a result one face of the seating aperture of the outlet spout is pressed against a face of the securing body, characterized in that d) the threaded hole of the outlet spout and the locking screw which can be screwed into this is angled in comparison to the profile of the seating aperture of the outlet spout and the outer contour of the securing body so that when the locking screw is screwed in, two faces of the seating aperture of the outlet spouts standing at an angle to each other are pressed against two faces of the securing body standing at a corresponding angle to each other.

2. A bath tap fitting according to claim 1, characterized in that the cross-section of the securing body was the shape of a polygon with rounded corners and that the locking screw lies against a rounded connecting face between two adjacent flat faces of the securing body.

3. A bath tap fitting according to claim 2, characterized in that the cross-section of the securing body is in the shape of a square with rounded corners.

* * * * *